US009265360B2

(12) United States Patent
Joseph et al.

(10) Patent No.: US 9,265,360 B2
(45) Date of Patent: Feb. 23, 2016

(54) INTEGRATED SHELF STANDARD

(71) Applicant: Heatcraft Refrigeration Products LLC, Richardson, TX (US)

(72) Inventors: Poly Joseph, Columbus, GA (US); Virgil L. Pearson, Columbus, GA (US); Rahul Gokhale, Stone Mountain, GA (US)

(73) Assignee: Heatcraft Refrigeration Products LLC, Richardson, TX (US)

( * ) Notice: Subject to any disclaimer, the term of this patent is extended or adjusted under 35 U.S.C. 154(b) by 23 days.

(21) Appl. No.: 14/150,934

(22) Filed: Jan. 9, 2014

(65) Prior Publication Data

US 2015/0189998 A1 Jul. 9, 2015

(51) Int. Cl.

| | |
|---|---|
| ***A47F 3/04*** | (2006.01) |
| ***A47B 96/14*** | (2006.01) |
| ***A47F 5/10*** | (2006.01) |

(52) U.S. Cl.

CPC ..... *A47F 3/0486* (2013.01); *A47B 96/1458* (2013.01); *A47F 5/10* (2013.01); *Y10T 29/49826* (2015.01)

(58) Field of Classification Search

CPC ..... A47B 96/14; A47B 96/1408; A47B 96/1416; A47B 96/1425; A47B 96/1433; A47B 96/145; A47B 96/1458; A47B 55/00; A47B 47/021; A47B 47/022; A47B 47/024; A47B 47/025; A47B 1/00; A47B 96/06; A47B 96/061; A47B 57/06; A47B 57/08; A47B 57/10; A47B 57/16; A47B 57/20; A47B 57/30; A47B 57/32; A47B 57/34; A47B 57/40; A47B 57/402; A47B 57/404; A47B 57/406; A47B 57/42; A47B 57/48; A47B 57/482; A47B 57/485; A47B 57/52; A47B 57/562; F25D 25/02; A47F 3/0486; A47F 5/10

See application file for complete search history.

(56) References Cited

U.S. PATENT DOCUMENTS

| | | | | | |
|---|---|---|---|---|---|
| 2,297,087 | A * | 9/1942 | Vanderveld | 248/243 |
| 3,647,079 | A * | 3/1972 | Ohlin | 211/192 |
| 4,205,815 | A * | 6/1980 | Sauer et al. | 248/243 |
| 5,285,602 | A * | 2/1994 | Felton | 52/36.6 |
| 5,336,100 | A * | 8/1994 | Gabrius et al. | 439/115 |
| 6,065,821 | A * | 5/2000 | Anderson et al. | 312/408 |
| 6,527,406 | B1 * | 3/2003 | Slesinger et al. | 362/127 |
| 6,813,896 | B1 * | 11/2004 | Janke et al. | 62/126 |
| 7,533,948 | B2 * | 5/2009 | Smith et al. | 312/408 |
| 7,676,992 | B2 * | 3/2010 | Burns | 52/36.6 |
| 7,784,626 | B2 * | 8/2010 | Jacques et al. | 211/103 |
| 7,918,516 | B2 * | 4/2011 | Decker et al. | 312/116 |
| 8,123,315 | B2 * | 2/2012 | Hagele et al. | 312/408 |
| 2004/0237853 | A1 * | 12/2004 | Sholz | 108/107 |

(Continued)

FOREIGN PATENT DOCUMENTS

| | | | | |
|---|---|---|---|---|
| DE | 102007028395 | A1 * | 12/2008 | A47F 11/10 |
| WO | WO2008019516 | A1 * | 2/2008 | A47B 57/40 |
| WO | WO2008135427 | A1 * | 11/2008 | F25D 23/06 |

*Primary Examiner* — Andrew Roersma

(74) *Attorney, Agent, or Firm* — Sutherland Asbill & Brennan LLP

(57) ABSTRACT

The present application provides a refrigerated display case. The refrigerated display case may include an aft wall, a number of shelf standards positioned about the aft wall, and a number of shelves positioned on the shelf standards. The shelf standards may include an integrated center shelf standard.

15 Claims, 5 Drawing Sheets

(56) References Cited

U.S. PATENT DOCUMENTS

2010/0295435 A1* 11/2010 Kendall et al. ..... 312/401
2011/0164399 A1* 7/2011 Driver et al. ..... 362/92
2011/0168651 A1* 7/2011 Stenftenagel et al. ..... 211/42
2011/0204009 A1* 8/2011 Karan ..... 211/59.2
2011/0215212 A1* 9/2011 Keyvanloo ..... 248/220.22
2011/0283632 A1* 11/2011 Sutton et al. ..... 52/36.1
2012/0043874 A1* 2/2012 Simpson et al. ..... 312/408
2012/0140440 A1* 6/2012 Dam et al. ..... 362/92

* cited by examiner

FIG. 1 --Prior Art--

--Prior Art--

--Prior Art--

--Prior Art--

INTEGRATED SHELF STANDARD

TECHNICAL FIELD

The present application and the resultant patent relate generally to modular refrigeration systems and more particularly relate to a refrigerated display case and the like with an integrated center shelf standard for a reduction in the number of overall parts and in installation time.

BACKGROUND OF THE INVENTION

The modern supermarket may have any number of refrigerated display cases to store and display different types of frozen and refrigerated products. Many different types of refrigerated display cases may be used, including multi-deck coolers, reach-in coolers, and the like. The refrigerated display cases generally are modular in nature such that any number of individual units may be combined to create a display case of any suitable length. Although the components of a refrigerated display case may be substantially modular in nature, the installation of such a refrigerated display case may involve a considerable amount of on-site labor to install the refrigeration components such as the associated evaporator coils, plumbing, fans, and controls as well as shelves, lighting, and the like.

There is thus a desire for an improved refrigerated display case and a method of installing the same. The installation of such an improved refrigerated display case may be simplified through the use of fewer parts and overall lighter parts in a dedicated construction.

SUMMARY OF THE INVENTION

The present application and the resultant patent thus provide a refrigerated display case. The refrigerated display case may include an aft wall, a number of shelf standards positioned about the aft wall, and a number of shelves positioned on the shelf standards. The shelf standards may include one or more integrated center shelf standards herein.

The present application and the resultant patent further provide a method of installing a refrigerated display case. The method may include the steps of positioning a right handed shelf standard about an aft wall, positioning a left handed shelf standard about the aft wall, positioning an integrated center shelf standard about the aft wall, and positioning a number of shelves about the right handed shelf standard, the left handed shelf standard, and the integrated center shelf standard.

The present application and the resultant patent further provide an integrated center shelf standard. The integrated center shelf standard may include an attachment flange, an extension portion attached to the attachment flange, a first channel portion attached to the extension portion, a bracket portion attached to the first channel portion, and a second channel portion attached to the bracket portion.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
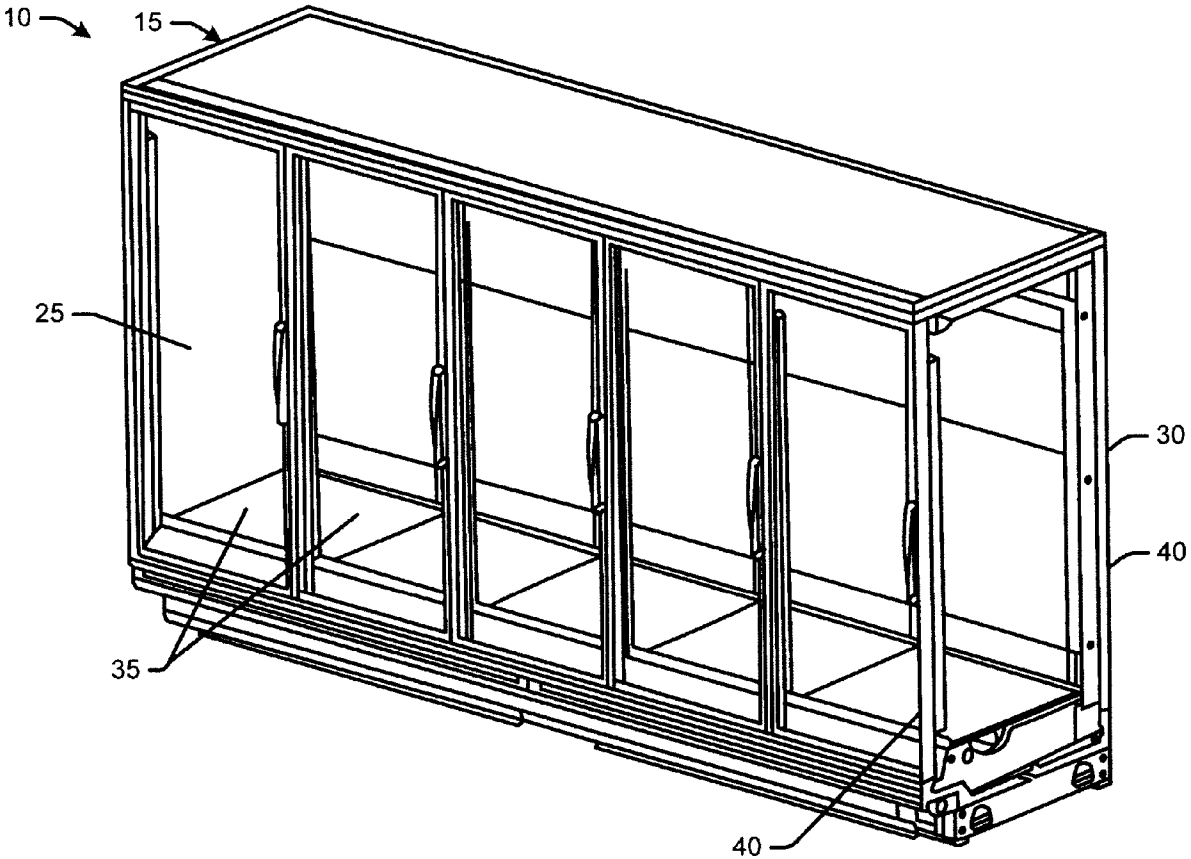
FIG. 1 is a perspective view of a portion of a known refrigerated display case in the form of a reach-in cooler.
Figure 2:
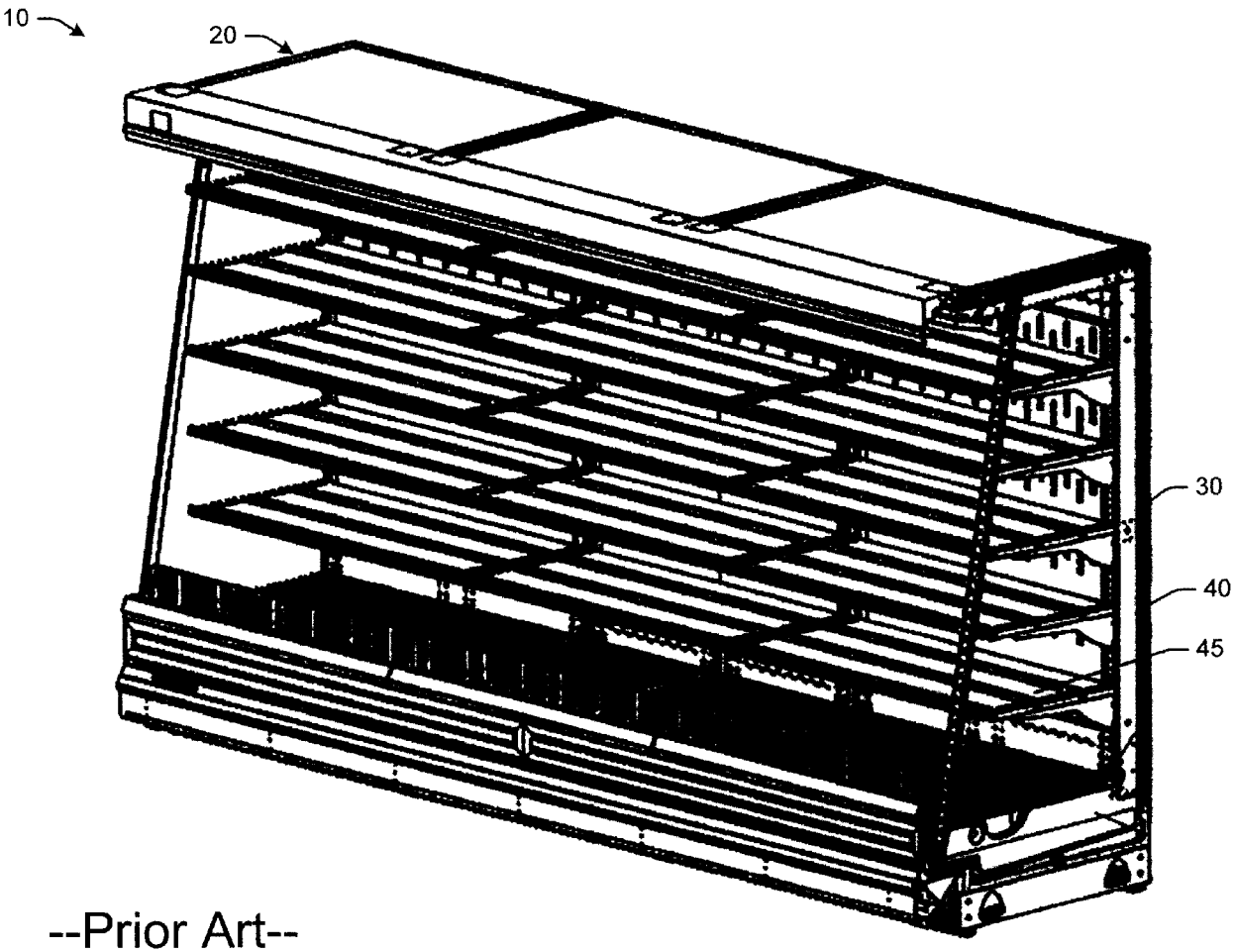
FIG. 2 is a perspective view of a portion of a known refrigerated display case in the form of a multi-deck cooler.

Referring now to the drawings, in which like numerals refer to like elements throughout the several views, FIG. 1 shows an example of a refrigerated display case 10 in the form of reach-in cooler 15. FIG. 2 shows an example of the refrigerated display case 10 in the form of a multi-deck cooler 20. In both examples, the refrigerated display case 10 may be substantially modular and may extend to any suitable length. The refrigerated display case 10 may define a refrigerated space 25. Any type or number of refrigerated or frozen products may be positioned within the refrigerated space 25. The refrigerated display case 10, and the components thereof, may have any suitable size, shape, or configuration. Other types of refrigerated display cases 10 may be used.

Generally described, the refrigerated display case 10 may include an aft wall 30. The aft wall 30 may include a number of insulated panels and may define an air plenum therethrough for a flow of refrigerated air. The aft wall 30 may have any suitable size, shape, or configuration. In the case of the reach-in cooler 15, the refrigerated display case 10 also may include a number of door panels 35. The door panels 35 may have any suitable size, shape, or configuration. The door panels 35 may be transparent in whole or in part. In the case of the multi-deck cooler 20, the multi-deck cooler 20 is largely open to the consumer. A number of shelf standards 40 may be positioned about the aft wall 30. The shelf standards 40 generally may be made out of a rigid metal or any type of substantially rigid, load bearing material. The shelf standards 40 also may support a number of shelves 45 thereon. The shelves 45 may have any size, shape, or configuration. Any number of shelves 45 may be used herein. Other components and other configurations also may be used herein.

Figure 4:
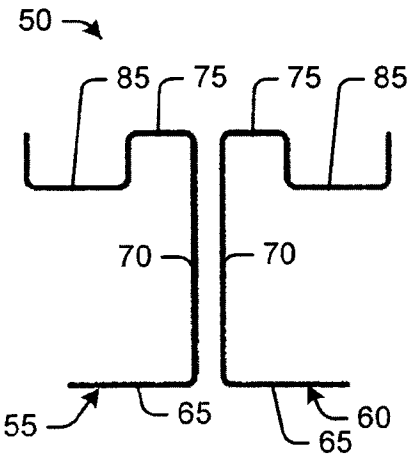
FIG. 4 is a side plan view of the known two part center shelf standard of FIG. 3.
Figure 3:
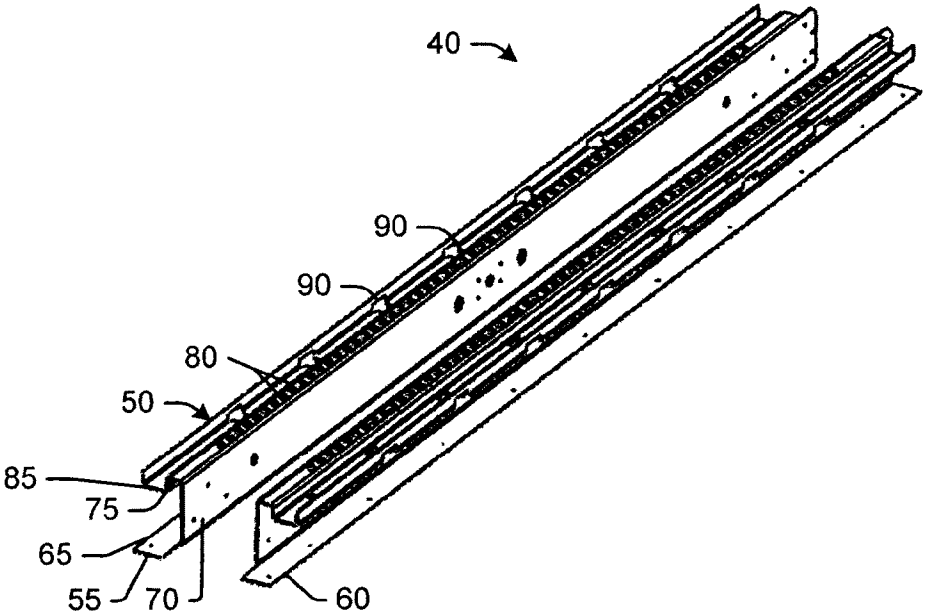
FIG. 3 is an exploded view of a known two part center shelf standard.

FIGS. 3 and 4 show an example of one of the shelf standards 40. In this example, a center shelf standard 50 is shown. The center shelf standard 50 is usually in the form of a two-piece part. Specifically, a left handed shelf standard 55 and a right handed shelf standard 60 may be combined. The left handed shelf standard 55 and the right handed shelf standard 60 may be substantially mirror images of each other. The refrigerated display case 10 thus may use the left handed shelf standard 55 on the left side, the right handed shelf standard 60 on the right side, and a combined left handed shelf standard 55 and right handed shelf standard 60 as the center shelf standard 50. The left handed shelf standard 55 and the right handed shelf standard 60 are generally aligned in the field to form the center shelf standard 50 and attached together via a number of huckbolts or other type of fastener. The overall alignment process may be a time intensive exercise.

Each individual shelf standard 55, 60 may include an attachment flange 65. The attachment flange 65 may be bolted to the aft wall 30 or elsewhere. Each shelf standard 55, 60 also may include an extension portion 70. The extension portion 70 may be substantially perpendicular to the attachment flange 65. The respective shelf standards 55, 60 may be attached via the extension portions 70. The shelf standards 55, 60 may include a bracket portion 75. The bracket portion 75 may have a number of bracket apertures 80 therein. The brackets of the shelves 45 may be positioned within the bracket apertures 80 of the bracket portion 75 and be supported therein. The shelf standards 55, 60 also may include a channel portion 85. The channel portion 85 may include a number of wiring plugs 90. The wiring plugs 90 may be sized for electrical wiring and the like to extend therethrough. The shelf standards 55, 60 described herein are for the purpose of example only. Shelf standards 55, 60 of many different sizes, shapes, and configurations may be known.

Figure 5:
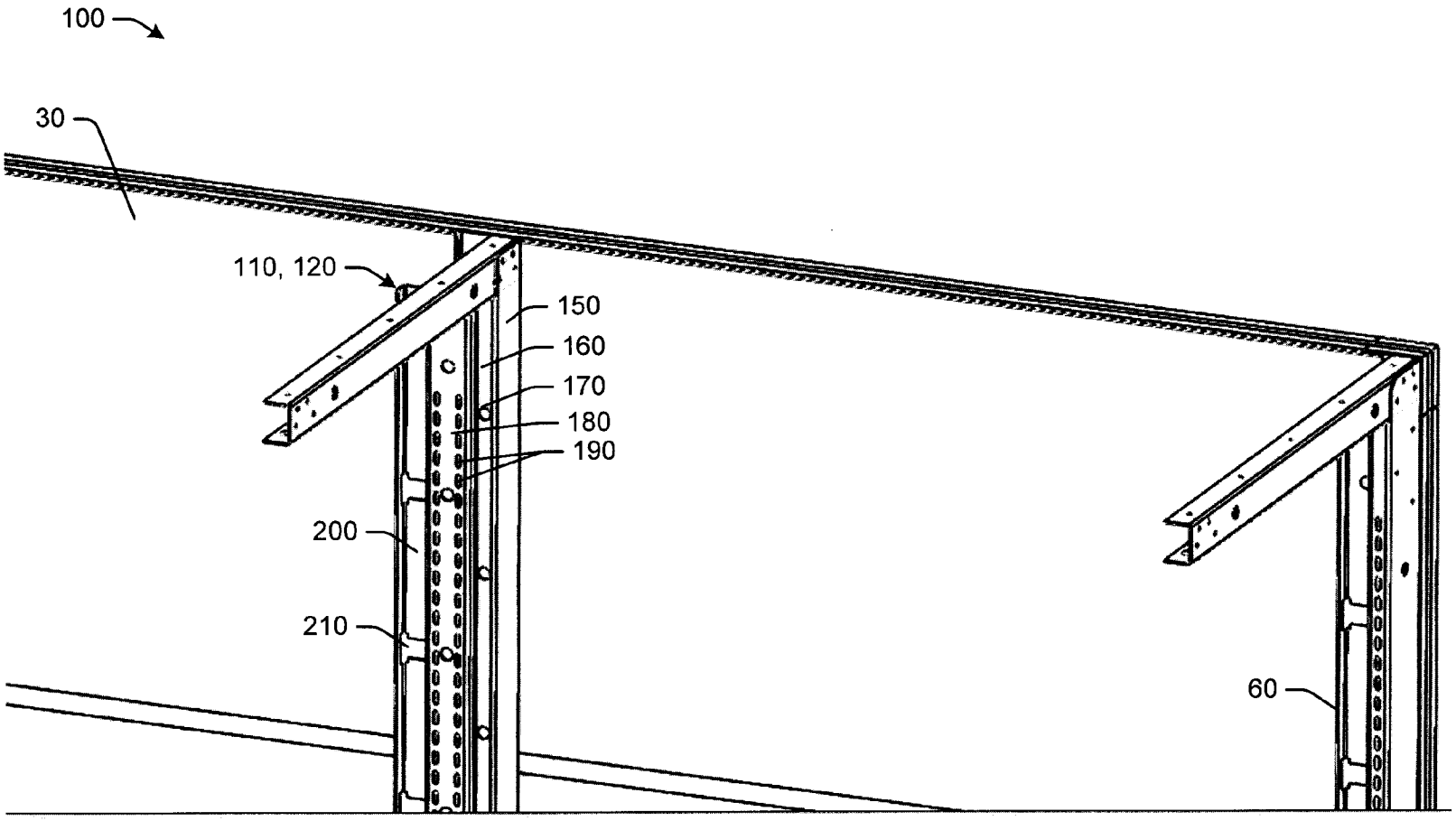
FIG. 5 is a perspective view of a portion of a refrigerated display case with an integrated center shelf standard as may be described herein.
Figure 7:
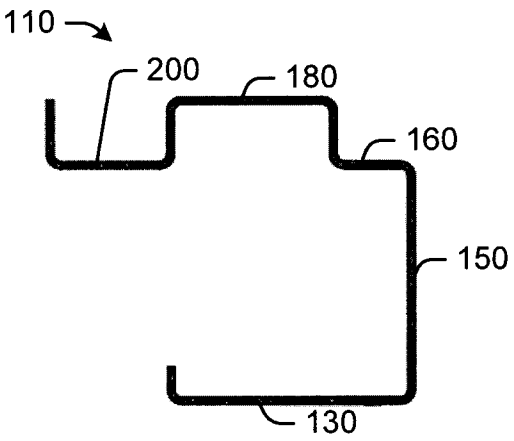
FIG. 7 is a side plan view of the integrated center shelf standard of FIG. 5 above.
Figure 6:
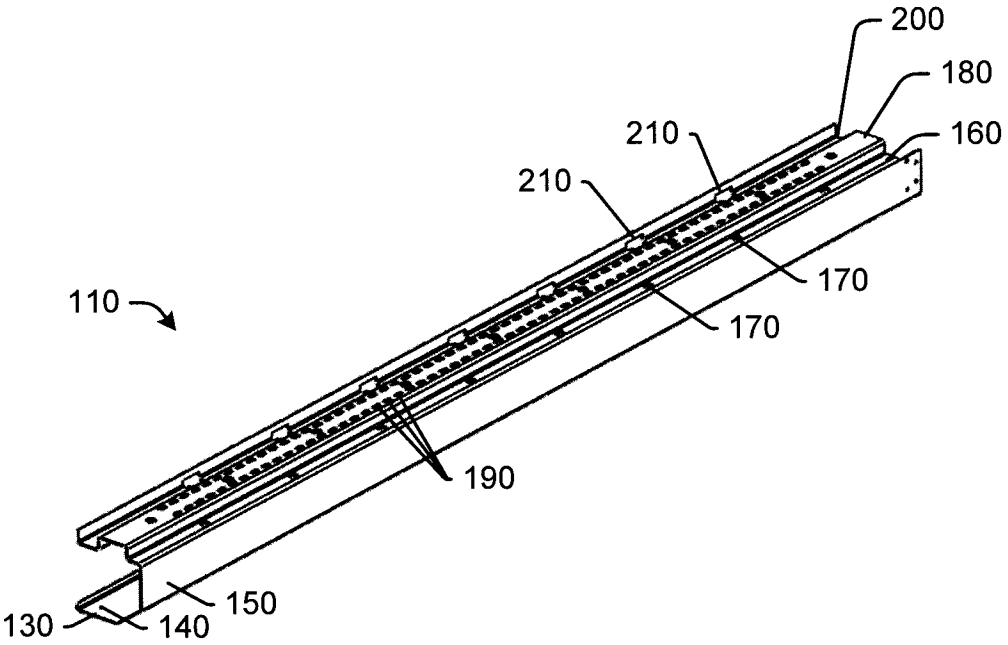
FIG. 6 is a perspective view of the integrated center shelf standard of FIG. 5.

FIG. 5 shows a portion of a refrigerated display case 100 as may be described herein. The refrigerated display case 100 may be a reach-in cooler, a multi-deck cooler, and the like. Other types of refrigerated display cases 100 may be used herein. As is shown in FIGS. 5-7, the refrigerated display case 100 may include a number of integrated shelf standards 110. The integrated shelf standard 110 may be a single element instead of the two piece part described above. The integrated shelf standards 110 may be attached to the aft wall 30 of the refrigerated display case 100 and may be used to support a number of shelves 45 thereon. The shelves 45 may have any size, shape, or configuration. In this example, the integrated shelf standard 110 may be an integrated center shelf standard 120. Any number of the integrated shelf standards 110 may be used in any length or width. The integrated shelf standard 110 may be made out of any type of substantially rigid, load bearing metals and other materials.

The integrated shelf standard 110 may include an attachment flange 130. The attachment flange 130 may have a number of attachment apertures 140. The attachment flange 130 may be used to attach the integrated shelf standard 110 onto the aft wall 30 or elsewhere. The attachment flange 130 and the attachment apertures 140 may have any size, shape, or configuration. The integrated shelf standard 110 may have an extension portion 150. The extension portion 150 may be substantially perpendicular to the attachment flange 140. The extension portion 150 may have any suitable size, shape, or configuration. The integrated shelf standard 110 may have a first channel portion 160. The first channel portion 160 may have a number of access apertures 170 therein. The access apertures 170 may align with the attachment apertures 140 so as to provide access for attaching the integrated shelf standard 110 to the aft wall 30 or otherwise. The first channel portion 160 and the access apertures 170 may have any size, shape, or configuration.

The integrated shelf standard 110 may include a bracket portion 180. The bracket portion 180 may include a number of bracket apertures 190. The bracket apertures 190 may be used to accommodate the brackets of the shelves 45 therein. The bracket portion 180 and the bracket apertures 190 may have any size, shape, or configuration. Any number of the bracket apertures 190 may be used. The integrated shelf standard 110 also may include a second channel portion 200. The second channel portion 200 may have a number of wiring plugs 210 positioned thereon. The wiring plugs 210 may be sized for electrical wiring and the like to extend therethrough. The second channel portion 200 and the wiring plugs 210 may have any size, shape, or configuration. Any number of the wiring plugs 210 may be used. Other components and other configurations may be used herein.

In use, the integrated shelf standard 110 may be directly attached to the aft wall 30. More than one integrated center shelf standard 110 may be used depending upon the size of the overall refrigerated display case 100. The shelves 45 then may be directly attached to the integrated shelf standard 110 and the other shelf standards 55, 60. By being integrated, the integrated shelf standard 110 thus avoids the alignment issues known with existing center shelf standards so as to reduce installation time. Moreover, the requirements of the huckbolts or other types of fasteners may be eliminated. The total number of parts required for the refrigerated display case 110 thus may be reduced as well as the overall material costs. Further, the integrated shelf standard 110 may adequately carry the load of the shelves 45 and the merchandise thereon but with a significant reduction in the amount of material used as compared to the known two part shelf standards described above. Finite element analysis shows similar structural strength given typical loads. Moreover, the unneeded wiring plugs on one side may be eliminated. The integrated shelf standard 110 thus provides an improved refrigerated display case 100 in terms of overall costs and parts.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A refrigerated display case, comprising:
an aft wall;
a plurality of shelf standards positioned about the aft wall;
the plurality of shelf standards comprising an integrated center shelf standard comprising:
an attachment flange configured to attach to the aft wall;
an extension portion extending from the attachment flange;
a bracket portion aligned with the attachment flange, such that the integrated center shelf standard comprises an open-walled chamber formed by the attachment flange, the extension portion, and the bracket portion;
a first channel portion separating the extension portion and the bracket portion, the first channel portion comprising a first wall extending perpendicular to the extension portion and a second wall extending perpendicular to the first wall and the bracket portion, wherein the first channel portion is positioned along a corner of the open-walled chamber, and the first channel portion forms an outward facing channel; and
a second channel portion separated from the first channel portion by the bracket portion, the second channel portion comprising a third wall extending from the bracket portion, a fourth wall extending from the third wall, and a fifth wall extending from the fourth wall, wherein the third wall is perpendicular to the bracket portion, the fourth wall is perpendicular to the third wall, and the fifth wall is perpendicular to the fourth wall;
wherein the integrated center shelf standard is a single piece; and
a plurality of shelves positioned on the plurality of shelf standards.

2. The refrigerated display case of claim 1, wherein the plurality of shelf standards comprises a left handed shelf standard and a right handed shelf standard.

3. The refrigerated display case of claim 1, wherein the attachment flange comprises with a plurality of attachment apertures.

4. The refrigerated display case of claim 3, wherein the first channel portion comprises a plurality of access apertures that aligns with at least one of the plurality of attachment apertures.

5. The refrigerated display case of claim 4, wherein the second channel portion comprises a plurality of wiring plugs therein.

6. The refrigerated display case of claim 1, wherein the bracket portion comprises a plurality of bracket apertures configured to receive one or more shelves.

7. The refrigerated display case of claim 1, wherein the attachment flange comprises a plurality of attachment apertures and the second channel portion forms a three-walled channel along a second corner of the open-walled chamber.

8. The refrigerated display case of claim 1, further comprising a reach-in cooler.

9. The refrigerated display case of claim 1, further comprising a multi-deck cooler.

10. The refrigerated display case of claim 1, wherein the integrated center shelf standard is formed from a single element.

11. The refrigerated display case of claim 1, wherein the plurality of shelf standards comprises three shelf standards.

12. The refrigerated display case of claim 1, wherein the plurality of shelf standards comprises a plurality of integrated center shelf standards.

13. The refrigerated display case of claim 1, wherein the plurality of shelves comprise a pair of brackets.

14. The refrigerated display case of claim 1, wherein the open-walled chamber of the integrated center shelf standard comprises an open sidewall.

15. A method of installing a refrigerated display case, comprising:

positioning a right handed shelf standard about an aft wall;

positioning a left handed shelf standard about the aft wall;

positioning an integrated center shelf standard about the aft wall, the integrated center shelf standard comprising:

an attachment flange configured to attach to the aft wall;

an extension portion extending from the attachment flange; and a bracket portion aligned with the attachment flange, such that the integrated center shelf standard comprises an open-walled chamber formed by the attachment flange, the extension portion, and the bracket portion;

a first channel portion separating the extension portion and the bracket portion, the first channel portion comprising a first wall extending perpendicular to the extension portion and a second wall extending perpendicular to the first wall and the bracket portion, wherein the first channel portion is positioned along a corner of the open-walled chamber, and the first channel portion forms an outward facing channel; and a second channel portion separated from the first channel portion by the bracket portion, the second channel portion comprising a third wall extending from the bracket portion, a fourth wall extending from the third wall, and a fifth wall extending from the fourth wall, wherein the third wall is perpendicular to the bracket portion, the fourth wall is perpendicular to the third wall, and the fifth wall is perpendicular to the fourth wall;

wherein the integrated center shelf standard is a single piece; and positioning a plurality of shelves about the right handed shelf standard, the left handed shelf standard, and the integrated center shelf standard.

* * * * *